US007589690B1

(12) United States Patent
Hertel

(10) Patent No.: US 7,589,690 B1
(45) **Date of Patent: *Sep. 15, 2009**

(54) METHOD, SYSTEM AND APPARATUS FOR AN ANTENNA

(75) Inventor: Thorsten W. Hertel, Austin, TX (US)

(73) Assignee: Alereon, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/893,284

(22) Filed: Aug. 15, 2007

Related U.S. Application Data

(63) Continuation of application No. 11/480,233, filed on Jun. 30, 2006, now Pat. No. 7,271,779.

(60) Provisional application No. 60/695,645, filed on Jun. 30, 2005.

(51) Int. Cl.
*H01Q 9/28* (2006.01)

(52) U.S. Cl. ..... 343/795; 343/700 MS

(58) Field of Classification Search ..... 343/700 MS, 343/795, 793, 803, 806, 820
See application file for complete search history.

(56) References Cited

U.S. PATENT DOCUMENTS

| | | | | |
|---|---|---|---|---|
| 3,813,674 | A | 5/1974 | Sidford | |
| 3,845,490 | A | 10/1974 | Manwarren et al. | |
| 4,005,430 | A | 1/1977 | Dubost et al. | |
| 4,825,220 | A | 4/1989 | Edward et al. | |
| 6,008,773 | A * | 12/1999 | Matsuoka et al. | 343/818 |
| 6,961,028 | B2 | 11/2005 | Joy et al. | |
| 7,116,960 | B2 * | 10/2006 | Kwon | 455/285 |
| 7,271,779 | B2 * | 9/2007 | Hertel | 343/795 |
| 2005/0035919 | A1 | 2/2005 | Yang et al. | |
| 2006/0170607 | A1 | 8/2006 | Yamagajo et al. | |
| 2006/0238433 | A1 | 10/2006 | Chou | |

* cited by examiner

*Primary Examiner*—Tan Ho
(74) *Attorney, Agent, or Firm*—Sprinkle IP Law Group

(57) ABSTRACT

Embodiments of the present invention provide a microstrip-coupled dipole antenna. A microstrip of the antenna may be formed in a plane and coupled to a transmission line such that the microstrip is operable to transfer electromagnetic energy fed to it by the transmission line to a dipole structure that, in turn, radiates a broadband electromagnetic signal.

17 Claims, 4 Drawing Sheets

METHOD, SYSTEM AND APPARATUS FOR AN ANTENNA

RELATED APPLICATIONS

This application is a continuation of U.S. patent application Ser. No. 11/480,233 by inventor Thorsten W. Hertel, entitled "Method, System and Apparatus for an Antenna" filed on Jun. 30, 2006 now U.S. Pat. No. 7,271,779, which claims priority from U.S. Provisional Patent Application Ser. No. 60/695,645 by inventor Thorsten W. Hertel, entitled "Omnidirectional UWB Dipole Antenna with Built-In Notch Filters" filed on Jun. 30, 2005, the entire contents of which are hereby expressly incorporated by reference for all purposes.

TECHNICAL FIELD OF THE INVENTION

The invention relates in general to methods, systems and apparatuses for antennas. More particularly, the invention relates to methods, systems and apparatuses for ultra wideband (UWB) antennas. Even more particularly the invention relates to omnidirectional UWB antennas.

BACKGROUND OF THE INVENTION

Recently, wireless data, entertainment and mobile communications technologies have become increasingly prevalent, particularly in the household and computing environment. The convergence of these wireless data, entertainment and mobile communications within the home and elsewhere has created the need for merging many disparate devices into wireless network architectures capable of seamlessly supporting and integrating the requirements of all of these devices. Seamless connectivity and rapid transfer of data, without confusing cables and wires for various interfaces that will not and cannot talk to each other, is a compelling proposition for a broad market.

To that end, communication industry consortia such as the MultiBand OFDM Alliance (MBOA), Digital Living Network Alliance (DLNA) and the WiMedia Alliance are establishing design guidelines and standards to ensure interoperability of these wireless devices. For example, Wireless 1394, Wireless USB, and native IP-based applications are currently under development based on ultra wideband (UWB) radio or WiMedia Convergence Platform.

Although it began as a military application dating from the 1960s, UWB has recently been utilized as a high data rate (480+Mbps), short-range (up to 20 meters) technology that is well suited to emerging applications in the consumer electronics, personal computing and mobile markets. When compared to other existing and nascent technologies capable wireless connectivity, the performance benefits of UWB are compelling. For example, transferring a 1 Gbyte file full of vacation pictures from a digital camera to a computer take merely seconds with UWB compared to hours using other currently available, technologies (i.e. Bluetooth) and consume far less battery power in doing so.

Typically, devices which employ UWB utilize a fixed channel bandwidth that is static in frequency, or a fixed channel bandwidth that can be frequency agile. In either case, the bandwidth utilized by a device must remain substantially fixed. Thus, the range and data rate of the device is, for the most part, determined by the modulation/coding of the signal, and the power with which the signal is transmitted.

In most cases as UWB, by definition, is spread over a broad spectral range, the power spectral density of a signal utilized by a UWB device is usually very low, and hence, usually results in low incidence of interference with other systems which may be utilizing the same bandwidth as the UWB device or system. However, to transmit signals of this type effectively an antenna must usually be utilized.

In fact, no matter the UWB system implemented, almost any transceiver implemented for a UWB system of the type discussed will require an antenna to transmit and receive information exchanged between the UWB systems. The antenna implemented in a UWB system is usually implemented in conjunction with the analog front end of the UWB transceiver and, as such, is responsible for radiating and receiving wideband (analog) electromagnetic signals.

In most cases, as the devices utilized to implement the UWB radio itself have shrunk in size, not only have portions of the radio itself shrunk, but additionally, the distances between the elements of the radio have decreased. In fact, in many cases UWB radios are implemented on a single printed circuit board (PCB), or one or more coupled PCBs, for use as a daughtercard, as a CardBus card, a PMCIA card, or with another type of interface.

Traditionally, monopole antennas were employed in these types of applications. However, monopole antennas present certain problems. Namely, these monopole antennas tend to be rather large, they often require large ground planes and their functionality and efficacy may vary widely if other elements of the UWB radio are placed in proximity to the ground plane. More specifically, monopole antennas, when placed over finite sized groundplanes may result in non-localized currents in these groundplanes which, in turn, could result in interference to other components of the radio with which these monopole antennas are being utilized.

Additionally, there may be frequency bands within a UWB channel where it is important to suppress interference. For example, some existing UWB spectrum allocation encompasses the C-Band satellite downlinks. Thus, there is a potential for UWB systems to interfere with television reception of those types of system. Currently, coexistence with 802.11a/b/g systems is regarded as important. Operation of a UWB radio in presence of these systems can be significantly improved if signal levels at the characteristic frequencies (802.11a in the US: 5.15-5.35 GHz and 802.11b/g in the US: 2.4 GHz) are suppressed before they reach an analog front end of a receiver. In these types of environments, it may be desired to create to reduce the power of a transmission in one or more areas of the transmission spectrum.

Thus, as can be seen, there is a need for antennas which may have reduced size, utilize smaller ground planes, exhibit a lesser degree of sensitivity to other elements of the radio in proximity to the antenna or which may be utilized to reduce the power of a signal within a certain frequency band.

SUMMARY OF THE INVENTION

Methods, systems and apparatuses for antennas are disclosed. Embodiments of the present invention provide a microstrip-coupled dipole antenna. A microstrip of the antenna may be formed in a plane and coupled to a transmission line such that the microstrip is operable to transfer electromagnetic energy fed to it by the transmission line to a dipole structure that, in turn, radiates a broadband electromagnetic signal.

In one embodiment an antenna has a dipole structure comprising a first antenna conductor and a second antenna conductor and a feed structure coupled to a feed point, wherein the feed structure is operable to couple a signal delivered to the feed point to the first antenna conductor and the second antenna conductor.

Embodiments of the present invention may have certain advantages, including that the microstrip-coupled feed may have an excellent transition from an unbalanced feed (e.g. coaxial line) to a balanced dipole structure so that cable currents are reduced significantly and distortions in the match and the pattern can thus be avoided.

Another technical advantage of embodiments of the present invention may be that, unlike typical UWB antennae, this antenna does not require a radio frequency (RF) connector to connect to a coaxial feed line. Therefore, the antenna does not require (though in some embodiments can include) a coax connector or an end launcher. Instead, the coax can attach directly to the antenna by soldering. Omitting this RF connector may reduce the cost and size of the antenna.

Additionally, embodiments of this invention may provide an antenna smaller than 6 mm by 30 mm and may not require any ground plane.

Furthermore, performance of embodiments of the present invention may be very good compared to prior art antennas of similar size. Prior art antennas typically have cable current affects. Thus, the balance implemented on prior art antennas does not work as well as the balance configuration of this antenna.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore nonlimiting, embodiments illustrated in the drawings, wherein identical reference numerals designate the same components. Note that the features illustrated in the drawings are not necessarily drawn to scale.

DETAILED DESCRIPTION

Figure 1:
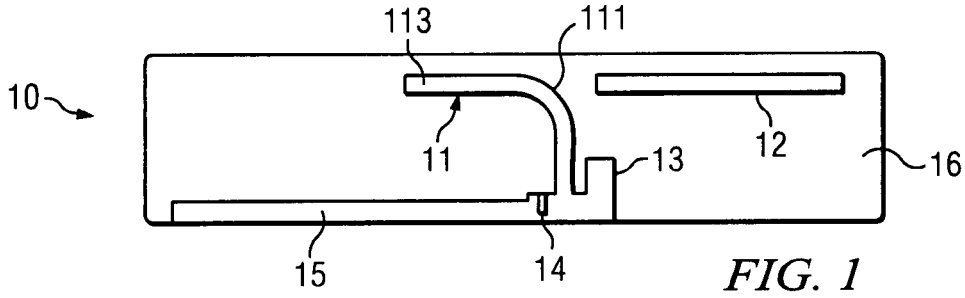
FIG. 1 depicts one embodiment of an antenna.

The invention and the various features and advantageous details thereof are explained more fully with reference to the nonlimiting embodiments that are illustrated in the accompanying drawings and detailed in the following description. Descriptions of well known starting materials, processing techniques, components and equipment are omitted so as not to unnecessarily obscure the invention in detail. Skilled artisans should understand, however, that the detailed description and the specific examples, while disclosing preferred embodiments of the invention, are given by way of illustration only and not by way of limitation. Various substitutions, modifications, additions or rearrangements within the scope of the underlying inventive concept(s) will become apparent to those skilled in the art after reading this disclosure.

Attention is now directed to methods, systems and apparatuses for antennas, embodiments of which may be utilized with UWB devices. Embodiments of the present invention provide a microstrip-coupled dipole antenna. A microstrip of the antenna may be formed on top of a printed circuit board (PCB), which may be formed at least partially of a material such as FR4, and coupled to a transmission line such that the microstrip is operable to transfer electromagnetic energy fed to it by the transmission line to a dipole structure on the bottom of the PCB that, in turn, radiates a broadband electromagnetic signal. Embodiments of the present invention may have a radiation pattern that is omnidirectional in one plane and generally has the type of "figure 8" pattern associated with a resonant dipole antenna. However, while the pattern of a resonant dipole may be very narrowband by nature, the pattern of embodiments of the present invention may be wideband and substantially frequency independent over a range of operation.

Furthermore, embodiments of the present invention may comprise a notch filter for reducing electromagnetic emissions in a certain frequency range. More specifically, in certain embodiments, elements implemented on the PCB can serve as notch filters at out-of-band frequencies with a rejection of greater than 10 dB. In one embodiment, the antenna may be utilized with a UWB device and can operate using rapid signals having a bandwidth approximately 20% greater than the center frequency (e.g. a minimum of approximately 500 MHz).

As discussed above, UWB systems need to coexist with other wireless systems. Thus, in certain embodiments, the antenna can operate in a frequency range between approximately 3.1 GHz to approximately 10.6 GHz, or in one specific embodiment, from approximately 3.17 GHz to approximately 4.75 GHz (e.g. substantially the first 3 bands in the standard Orthogonal Frequency Division Multiplexing (OFDM) banding scheme). Other embodiments of the present invention may provide a notch filter with a rejection in the frequency range from 5.15 to 5.35 GHz of 10 dB or better while some embodiments may provide a notch filter that can be adjusted to notch out frequencies at the low end of a spectrum.

Turning now to FIG. 1, a top view of one embodiment of an omnidirectional microstrip-coupled dipole antenna 10 is depicted. Microstrip antenna 10 may be a small form factor antenna (e.g., approximately 27 mm by 6 mm), be integrated on a high dielectric material (e.g., with a dielectric constant of approximately 10) for example a ceramic loaded PTFE woven glass material such as CER-10, with a high dielectric constant. Microstrip antenna 10 may also comprise a feed structure, such that a current source is driving the feed structure. Microstrip antenna 10 may also comprise a notch filter in a range specified by the Unlicensed National Information Infrastructure (UN-II) (e.g. approximately 5.15-5.35 GHz), a notch filter tunable to low frequencies or a direct coax cable solder attachment.

More specifically, microstrip antenna 10 includes a feed structure such as microstrip coupled line 11. Microstrip antenna 10 also includes notch filter 12, matching stub 13, feed point 14, and matching stub notch 15 formed on, or in, dielectric material 16. A coaxial (coax) conductor operable to carry an electromagnetic signal to antenna 10 may be coupled to feed point 14, as are matching stub 13 and matching stub notch 15. The coupling between the coax conductor and antenna 10 may be accomplished with a SubMiniature version A (SMA) end launcher, they may be directly connected or another methodology used for the coupling.

The other features 11-15 shown in FIG. 1 may, in one embodiment, be constructed of copper. In particular, these features 11-15 may be manufactured from substantially 1 ounce copper, where 1 ounce of copper is approximately equivalent to 1.4 mil thickness. The range of copper thickness is from 0.5 to 1.5 ounce copper. If the copper thickness varies substantially from 1 ounce copper, the length and the width of the microstrip of notch 12 and position of notch 12 may vary. Further, the position of notch 12 may need to vary. The required changes to accommodate varying the copper thickness may be determined either numerically or empirically.

In one embodiment, matching stub 13 may serve to improve matching substantially with the frequency band, 3.17 GHz-3.6 GHz. Furthermore, notch filter 12 may serve to reduce the power of signals transmitted by microstrip antenna 10 over a bandwidth of approximately 200 MHz bandwidth in substantially the frequency range of 5.15-5.35 GHz (e.g. to reduce out-of-band interference) such that notch filter 12 may help a device with which microstrip antenna 10 is utilized coexist with other electronic devices (by reducing interference between these devices). In particular, notch filter 12 may help to reduce interference caused by a device using microstrip antenna 10 with consumer electronic devices complying with IEEE standard 802.11.a.

Microstrip antenna 10 may also comprise matching stub notch 15 operable to implementing a notch filter for reducing the power of signals transmitted by microstrip antenna 10 in substantially the frequency range less than 3 GHz. More specifically, in certain embodiments antenna 10 may not be long enough to implement a notch filter around 2.4 GHz, but, as there is a certain amount of roll-off it may be possible to implement a steeper decline of the frequency response at the low end of frequency range in conjunction with antenna 10. Notch 12 and notch matching stub 15 may therefore, in certain embodiments, aid in the performance of antenna 10 while in other embodiment, the match of antenna 10 may be better without the notches 12, 15 as without these notches 12, 15 0.5 dB of gain may be realized.

Other embodiments of antenna 10 may not have notches 12, 15, or in particular, may not have these notches 12, 15 at the uniband. In this case, a broadbanding scheme may be used to shrink the size of antenna 10. Thus, the length of an antenna such as the omnidirectional microstrip-coupled dipole antenna 10 may be reduced using an alternate broadbanding scheme such as those described later in more detail.

In one embodiment, the shape and length of microstrip coupled line 11 is designed for matching in a particular frequency range. Microstrip 11 may include a vertical section, a curved, or quarter-circle, section, a horizontal section, combination of these shapes, or another shape entirely. In other words, in certain embodiments, microstrip coupled line 11 may comprise a first portion 111 which extends along a first axis and a second portion 113 which extends along a second axis perpendicular to the first axis. These two portions may be joined by a curvilinear portion of microstrip coupled line 11. The relative sizes and placements of these sections may determine the matching achieved.

Furthermore, microstrip coupled line 11 may serve to drive antenna 10. It will be noted that the particular shape of microstrip coupled line 11 to be utilized in a given embodiment of antenna 10 may be determined empirically or via simulation taking into account various factors such as bandwidth desired, material utilized for various features of the antenna, shape and size of the dipole radiators of antenna 10, etc.

Figure 2:
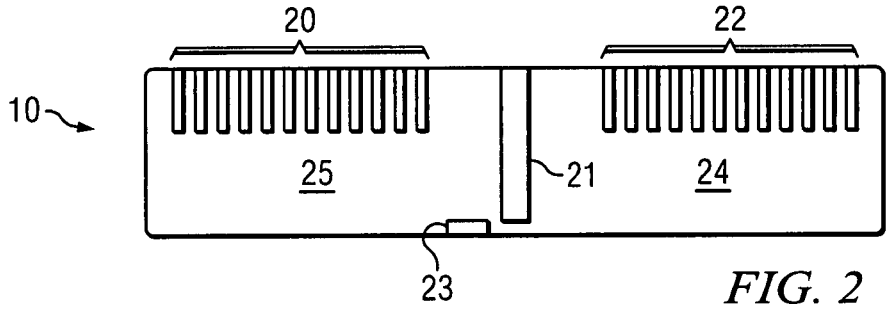
FIG. 2 depicts one embodiment of an antenna.

This arrangement may be illustrated more clearly with reference to FIG. 2 which depicts one embodiment of another view of antenna 10. More specifically, FIG. 2 is a bottom view of the embodiment of the omnidirectional microstrip-coupled dipole antenna 10 of FIG. 1. Features of the embodiment of the antenna 10 include left teeth 20, dipole gap 21, right teeth 22, feed point 23, right antenna conductor 24 and left antenna conductor 25. Right teeth 22 are arranged beneath notch filter 12 (shown in FIG. 1). Feed point 23 may be the outer coax conductor is soldered to ground (or where the outer coax is coupled using a SubMiniature version A (SMA) end launcher or other means). At least a portion of microstrip coupled line 11 is approximately above feed point 23.

More particularly, in one embodiment the radiating element(s) of antenna 10 may be driven by the microstrip coupled line 11 where the radiating element(s) are arranged underneath microstrip coupled line 11. The length of the radiating element may substantially determine the frequency of antenna 10, and the dimensions of the microstrip coupled line 11 determine the match within that frequency range. Microstrip coupled line 11 may also bend over dipole gap 21 and serve to at least partially couple the energy from a coax conductor to the dipole gap. In other words, a signal may be transferred from the center conductor of the coax conductor into microstrip coupled line 11 and where microstrip coupled line 11 is over the dipole gap 11, energy is fed into the dipole gap 11 and dipole radiation behavior results (e.g. a dipole at the bottom of antenna 10 having an additional dipole pattern.

Left teeth 20 and right teeth 22 may serve at least two purposes. One purpose is extending the bandwidth of transmissions from antenna 10. The second purpose is that the right teeth 23 together with the notch filter 12 may implement a sharp (in terms of insertion loss) notch. It will be apparent that the orientation, geometry, number and spacing of teeth 20, 22 may vary, or teeth 20, 22 may be eliminated altogether, according to the embodiment desired.

In one embodiment, left teeth 20 and right teeth 22 may be substantially aligned along the same axis and have a certain amount of space between them (i.e. in a comb pattern). Having teeth 20, 22 along an edge, or proximate to an edge, of antenna 10, such as in FIG. 2, may allow metal to remain across the bottom of antenna 10, increasing performance.

Figure 3:
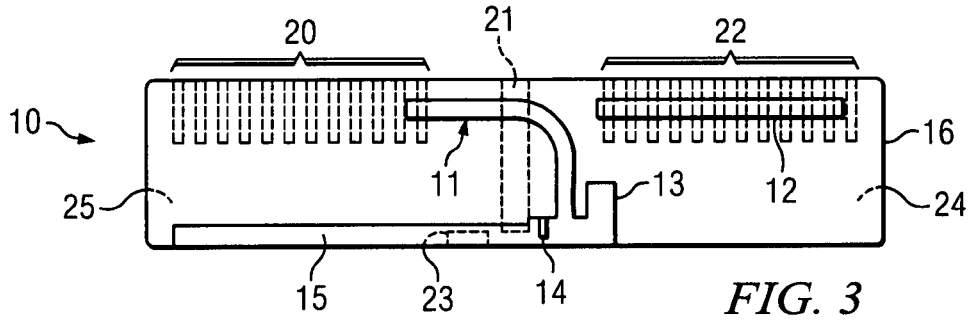
FIG. 3 depicts one embodiment of an antenna.
Figure 4:
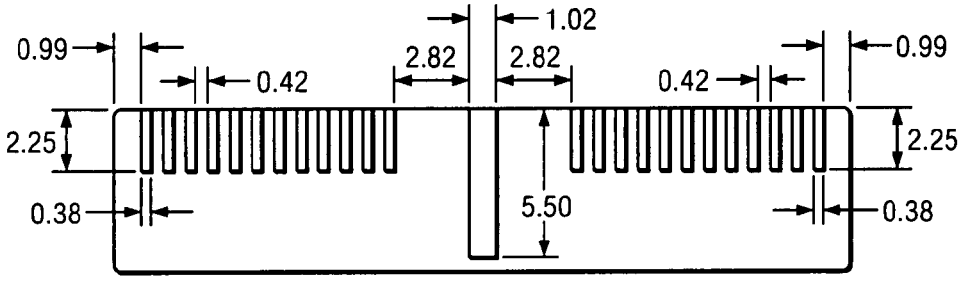
FIG. 4 depicts a schematic view of one embodiment of an antenna.
Figure 5:
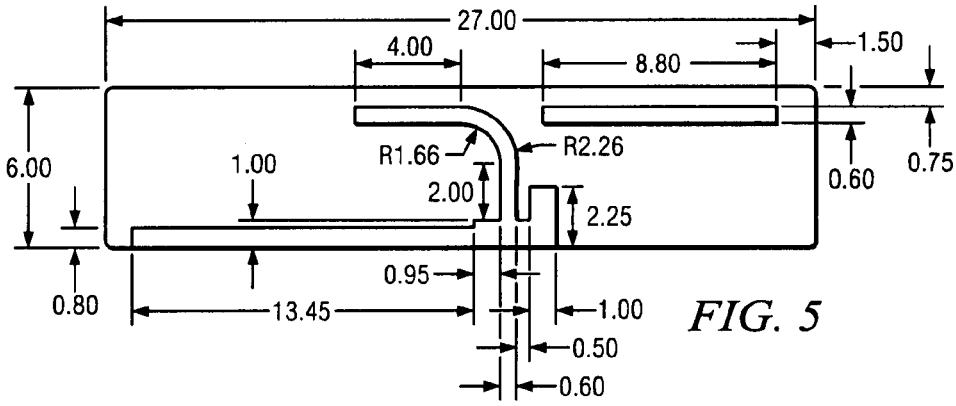
FIG. 5 depicts a schematic view of one embodiment of an antenna.

FIG. 3 depicts a composite view of an embodiment of the omnidirectional microstrip-coupled dipole antenna. This composite view includes features shown in the top and bottom views of FIG. 1 and FIG. 2. Features of the embodiment of the antennae include microstrip coupled line 11, notch filter 12, notched matching stub 15, matching stub 13, top feed point 14, dipole gap 21, bottom feed point 23, left teeth 20, right teeth 22, right antenna conductor 24, and left antenna conductor 25. Notice the placement of notch filter 12 with respect to right teeth 22. As shown in the embodiment of FIG. 3, notch filter 12 may overlap right teeth 22. Particular dimensions for one embodiment of an antenna such as is depicted in FIGS. 1-3 operable in approximately the 3.17 GHz to 4.75 GHz range are shown in FIGS. 4 and 5.

Figure 6:
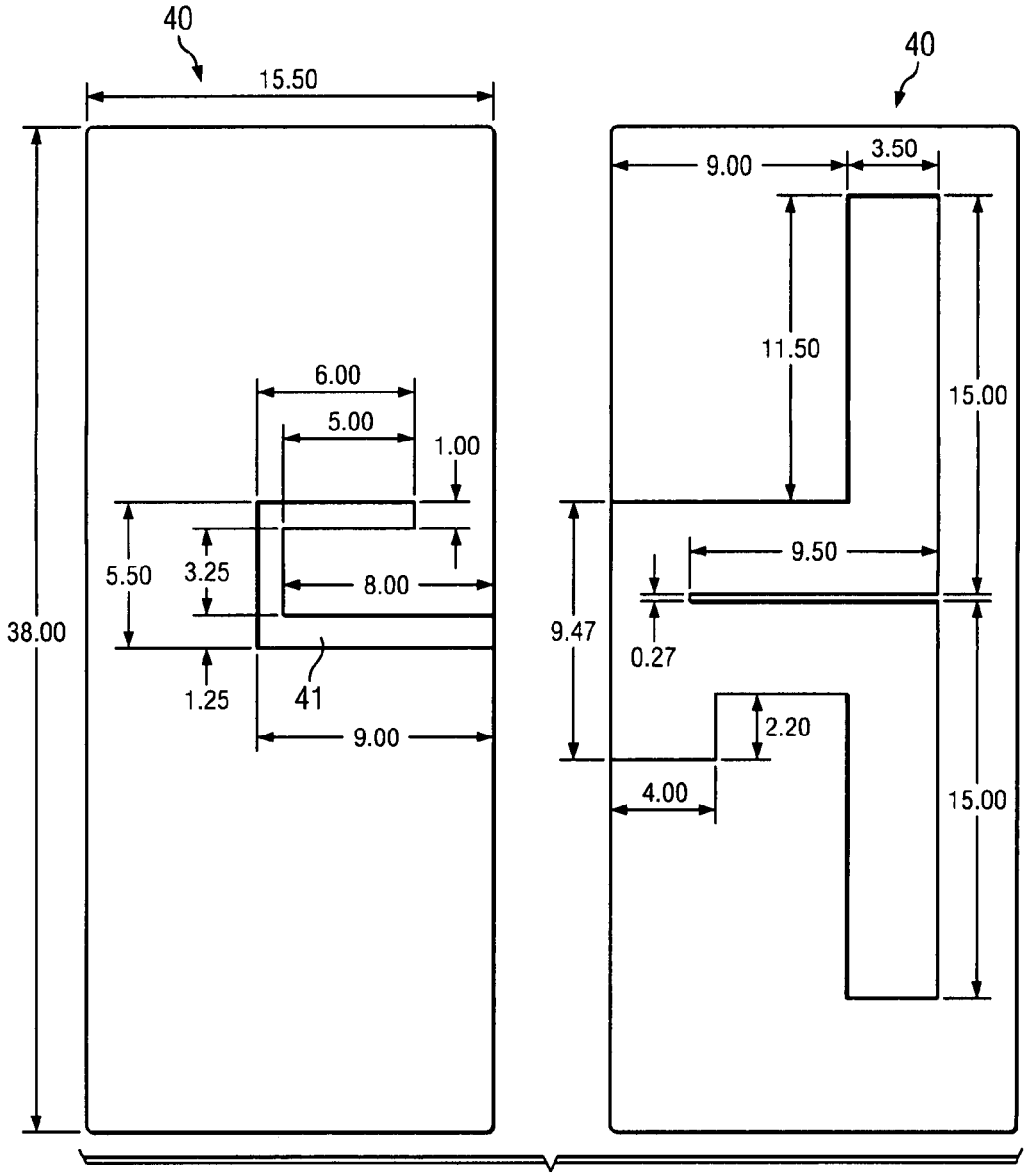
FIG. 6 depicts a schematic view of one embodiment of an antenna.

Moving to FIG. 6, a schematic view of another embodiment of an omnidirectional microstrip-coupled dipole antenna is presented. Embodiments such as the one depicted in FIG. 6 may be suited for manufacture using material with a lower dielectric constant and use in a frequency range between approximately 3.17 GHz and 4.75 GHz. For example, the embodiment of FIG. 6 may be manufactured using FR4, which has a dielectric constant in the range of about 4.2-4.6. Thus, in certain instances, omnidirectional microstrip-coupled dipole antenna 40 may be larger than embodiments of the omnidirectional microstrip-coupled dipole antenna manufactured using a material having a high dielectric constant (e.g., about 10).

Antenna 40 includes microstrip 41 having a U-shaped hook configuration, as shown. In other words, microstrip 41 may, in eon embodiment, have a first portion substantially oriented along a first axis, a second portion substantially oriented along a second axis perpendicular to the first axis and a third portion substantially oriented along the first axis. However, other embodiments may have microstrips having a vertical section, a quarter-circle section, or a horizontal section, much like microstrip 11 of FIGS. 1-3. Antenna 40 may also incorporate notches and/or combs similar to those described with respect to FIGS. 1-3.

Embodiments of antenna 40 may be significantly narrower than typical antennas which operate in similar frequency range(s) and/or which are manufactured from material having a similar dielectric constant. As shown in FIG. 6, antenna 40 can have dimensions of 38 mm by 15.5 mm. However, in other embodiment, these dimensions may be approximately 32 mm by 10 mm.

As a result of having a microstrip feed, antenna 40 may have a very good transition from the signal fed by an incoming unbalanced coax to the balanced dipole of the antenna 40. The dimensions of the dipole conductors may be approximately 15.5 mm or, in some cases may be as small as 10 mm or smaller.

Figure 7:
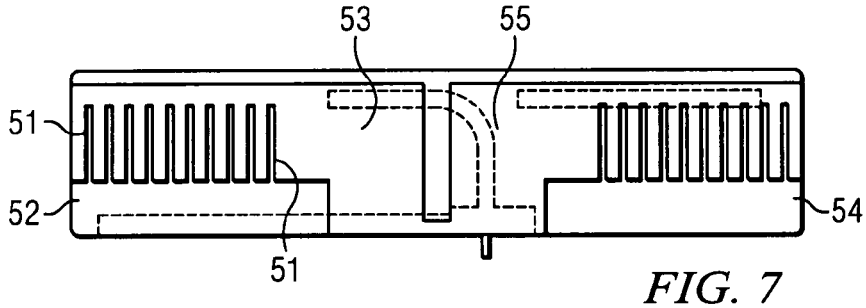
FIG. 7 depicts a schematic view of one embodiment of an antenna.

It will be noted that embodiments of the present invention may be applied to achieve almost any bandwidth desired. Turning to FIG. 7, embodiments of an embodiment of the present invention is depicted with a broadbanding scheme to achieve an extended bandwidth. As shown, teeth 51 may be configured in conductors 53 and 55 such that a downward comb pattern is formed. Further, cut-out portions 52 and 54 may be removed from antenna conductors 53 and 55, respectively.

Figure 8:
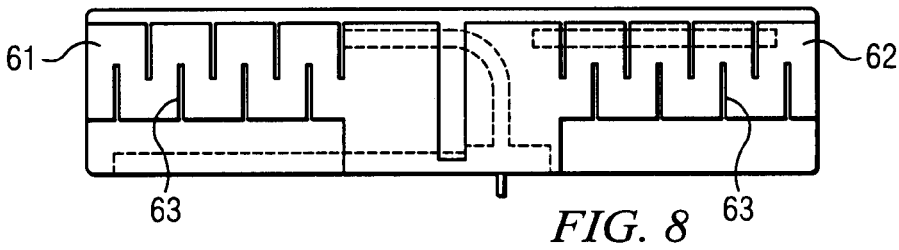
FIG. 8 depicts a schematic view of one embodiment of an antenna.
Figure 9:
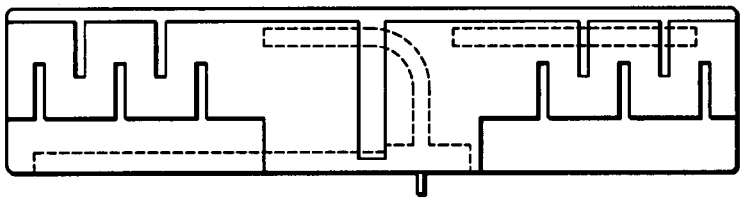
FIG. 9 depicts a schematic view of one embodiment of an antenna.

Another scheme for broadbanding is shown with respect to the composite view of one embodiment of the present invention as depicted in FIG. 8. Left dipole conductor 61 and right dipole conductor 62 are shown in a meanderline configuration. Dipole conductors 61 and 62 include cutout portions 63. The length and/or thickness of each cutout portions 63 (which may be varied to change parameters of the antenna, for example, distance between cutout portions 63, depth of portions 63, number of portions 63, etc.). The meanderline configuration may also have the added effect of reducing the size of the antenna. The zigzag pattern increases the path length and therefore shifts frequency operation to lower frequencies. Another meanderline configuration is shown in FIG. 9.

Figure 10:
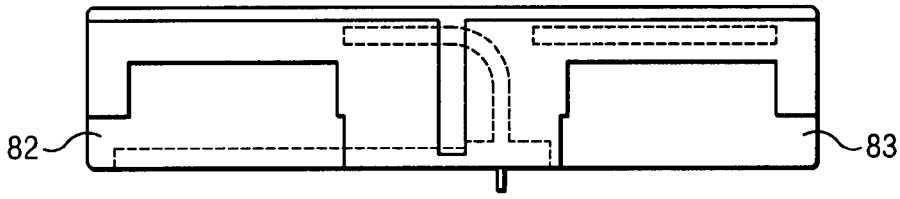
FIG. 10 depicts a schematic view of one embodiment of an antenna.

FIG. 10 is a composite view of an embodiment of the omnidirectional microstrip-coupled dipole antenna having yet another broadbanding scheme. As shown, cutout portions 82 and 83 may be used absent comb structures. The extent of the cutout portions is limited by the area needed for electron travel. An embodiment such as this, having a launching structure with the dipole in the center, was used for the initial empirical models.

Figure 11:
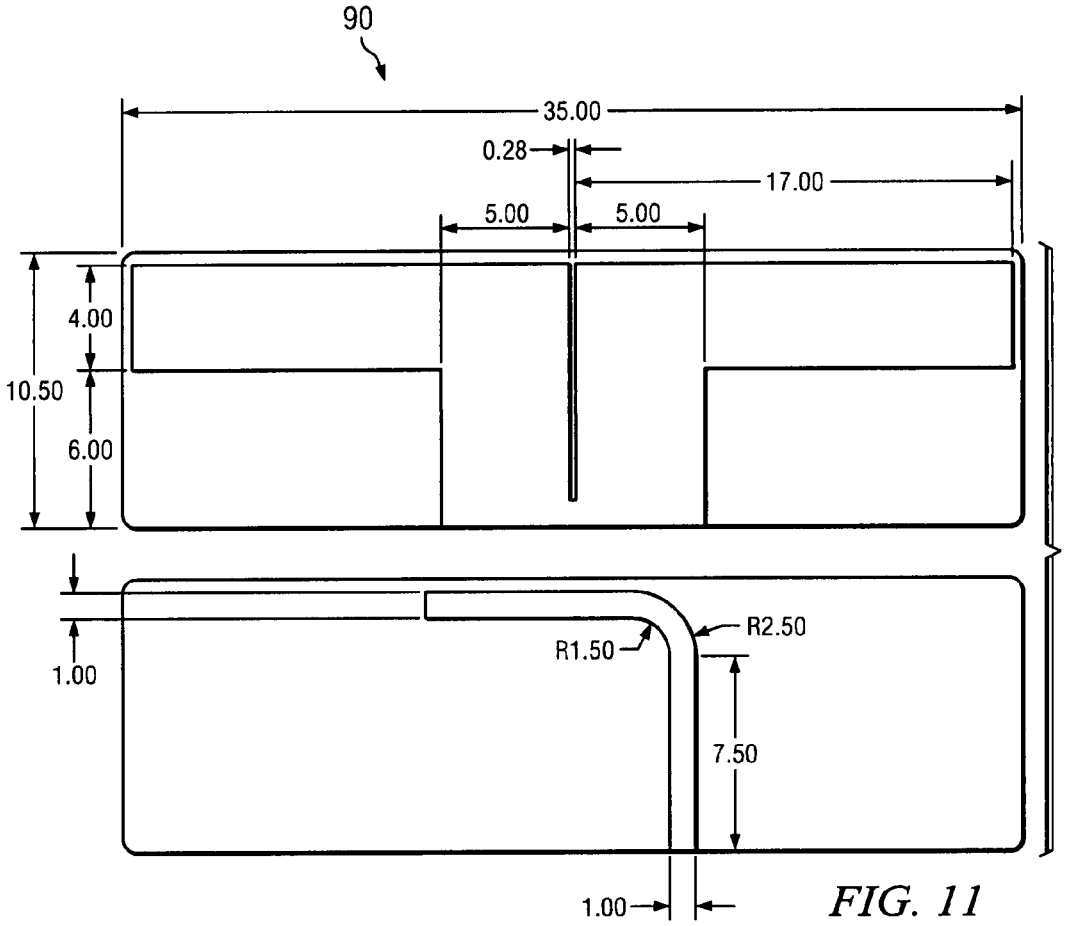
FIG. 11 depicts a schematic view of one embodiment of an antenna.

FIG. 11 is a schematic view of another embodiment of an antenna according to one embodiment of the invention. This embodiment may be well suited for manufacture using lower dielectric material such as FR4 and may be relatively small in size (compared with typical antennas of similar functionality).

Figure 12:
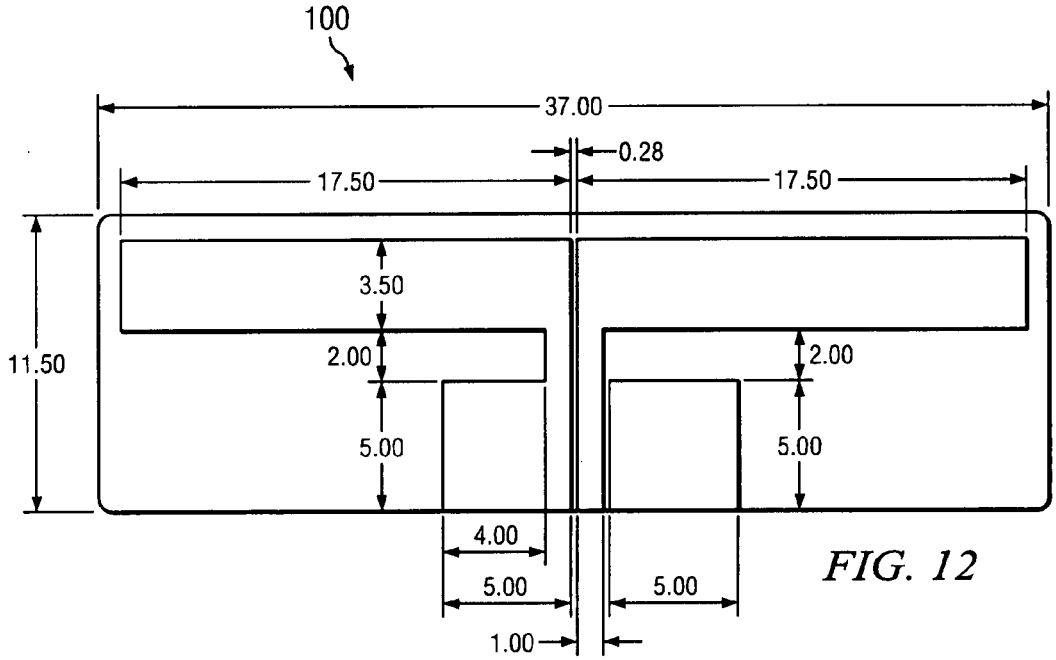
FIG. 12 depicts a schematic view of one embodiment of an antenna.

FIG. 12 is a schematic view of yet another embodiment of an antenna according to an embodiment of the present invention.

Methods, systems and apparatuses for just such antennas are disclosed herein. These antennas may be dipole antennas, wherein the antenna is integrated with the groundplane and a transceiver such that an entire radio may be included on a single card, such as a card designed for use with a CardBus card, PMCIA Card, daughtercard etc. In some embodiments, these antennas may be implemented utilizing a single layer of the PCB with which they are implemented, while in other embodiments these antennas may only utilize two layers of the PCB.

Additionally, as these antennas may be designed for use in conjunction with particular applications, such as for use with a card to be used on a CardBus or as a daughtercard, these antennas may be designed for use with a particular enclosure for the card (where the antenna may protrude from this enclosure or be surrounded by the enclosure). More specifically, the antenna may be designed in conjunction with a particular enclosure such that when the antenna is included on a card utilized with that enclosure the antenna may radiate substantially in the desired frequency range, as certain enclosures may increase the dielectric constant around the antenna and thus increase the radiating frequency of the antenna. This enclosure containing the card may then be utilized with a device (e.g. laptop) where it is desired to utilize a device with a UWB radio. In addition, embodiments of these antennas may utilize tapered slots to focus their radiation pattern in the endfire direction.

As the antenna may be integrated on the same card or board as the remainder of a radio device in certain embodiments these antennas may be driven directly from the transceiver itself. In some embodiments, these antennas may have the dipole over a small groundplane, in fact, the dipoles of the antenna may be integrated with the groundplane. These types of arrangements may beneficially serve to localize current on or near the groundplane with which antennas of this type are utilized. More particularly, when in these antennas are in use surface current may be localized to the top edge of the groundplane. This localized current may allow other components of the radio, including active components, to be placed near the ground plane without adversely affecting the performance of these antennas.

In the foregoing, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention. For example, though the above embodiments have been described with respect to antennas for use in a UWB radio it will be apparent that the same systems and methods will apply equally well to antennas designed to operate in other frequency ranges.

Furthermore, while certain shapes of elements such as microstrip coupled lines, notch filters, matching stubs, teeth, etc. have been described, and certain arrangements, orientations and placements of these elements such as comb structures, meander line structures, notch filters formed over teeth, microstrip lines formed over the dipole gap, etc., it will be apparent the combination of elements utilized in a given embodiment and the arrangement, orientation or placement of these elements will vary according to the functionality desired in a given embodiment of an antenna, and the efficacy of a particular arrangement orientation placement or combination of elements may be determined empirically or by virtue of simulation, and that the suitability of an embodiment of the antenna for a particular purpose or function may be similarly determined.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

What is claimed is:

1. An antenna, comprising:

a dipole structure comprising a first antenna conductor and a second antenna conductor, the first antenna conductor and the second antenna conductor separated by a dipole gap;

a feed structure, the feed structure electromagnetically coupling the first antenna conductor and the second antenna conductor and operable to couple a signal to the first antenna conductor and the second antenna conductor wherein a first portion of the feed structure is above a portion of the first antenna conductor and a second portion of the feed structure is above a portion of the second antenna conductor; and a notch filter, wherein the combination of the notch filter and the first antenna conductor or the second antenna conductor is operable to filter the signal.

2. The antenna of claim 1, wherein the feed structure is a microstrip coupled line.

3. The antenna of claim 2, wherein the microstrip coupled line extends along a first axis and a second axis.

4. The antenna of claim 1, wherein the first antenna conductor or the second antenna conductor is coupled to a ground plane.

5. The antenna of claim 1, wherein the feed structure is coupled to a feed point operable to be coupled to a radio apparatus.

6. The antenna of claim 5, wherein the feed point is coupled to one or more matching devices, wherein the matching devices may balance impedance or filter frequencies.

7. The antenna of claim 6, wherein the feed point is coupled to a matching stub.

8. The antenna of claim 6, wherein the feed point is coupled to a notched matching stub operable to filter frequencies.

9. The antenna of claim 1, wherein the first antenna conductor comprises a first set of teeth and the second antenna conductor comprises a second set of teeth.

10. The antenna of claim 9, wherein the combination of the notch filter and the first set of teeth or the second set of teeth is operable to filter the signal.

11. The antenna of claim 1, wherein the first antenna conductor comprises a first cutout and the second antenna conductor comprises a second cutout.

12. The antenna of claim 1, wherein the feed structure is formed on a first side of a dielectric and the dipole structure is formed on a second side of the dielectric, wherein the first side and the second side of the dielectric are in the same plane.

13. An antenna, comprising:

a dipole structure comprising a first antenna conductor and a second antenna conductor, the first antenna conductor and the second antenna conductor separated by a dipole gap;

a microstrip coupled line, the microstrip coupled line electromagnetically coupled to the dipole structure and operable to receive a signal from the dipole structure, wherein a first portion of the microstrip coupled line is above a portion of the first antenna conductor and a second portion of the microstrip coupled line is above a portion of the second antenna conductor; and a notch filter, wherein the combination of the notch filter and the first antenna conductor or the second antenna conductor is operable to filter the signal.

14. The antenna of claim 13, wherein the microstrip coupled line extends along a first axis and a second axis.

15. The antenna of claim 13, wherein the first antenna conductor or the second antenna conductor is coupled to a ground plane.

16. The antenna of claim 13, wherein the microstrip coupled line is coupled to a feed point operable to be coupled to a radio apparatus.

17. A method, comprising:

producing a dipole structure, wherein the dipole structure comprises a first antenna conductor and a second antenna conductor, the first antenna conductor and the second antenna conductor separated by a dipole gap;

positioning a microstrip coupled line above the dipole structure, wherein a first portion of the microstrip coupled line is above a portion of the first antenna conductor and a second portion of the microstrip coupled line is above a portion of the second antenna conductor, wherein the microstrip coupled line electromagnetically couples the first antenna conductor and the second antenna conductor and is operable to couple a signal to the first antenna conductor and the second antenna conductor; and positioning a notch filter above the first antenna conductor or the second antenna conductor, wherein the combination of the notch filter and the first antenna conductor or the second antenna conductor is operable to filter the signal.

* * * * *